US011174120B2

(12) United States Patent
Chang et al.

(10) Patent No.: US 11,174,120 B2
(45) Date of Patent: Nov. 16, 2021

(54) PRINTING DEVICE AND EJECTION CONTROL MODULE

(71) Applicant: PRIMAX ELECTRONICS LTD., Taipei (TW)

(72) Inventors: Yu-Lun Chang, Taipei (TW); Kun-Lin Wu, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 16/884,391

(22) Filed: May 27, 2020

(65) Prior Publication Data

US 2021/0292125 A1 Sep. 23, 2021

(30) Foreign Application Priority Data

Mar. 20, 2020 (TW) ..... 109109472

(51) Int. Cl.
*B65H 29/14* (2006.01)
*B65H 31/30* (2006.01)
*B65H 43/08* (2006.01)

(52) U.S. Cl.
CPC ..... *B65H 43/08* (2013.01); *B65H 29/14* (2013.01); *B65H 31/30* (2013.01); *B65H 31/3027* (2013.01); *B65H 2403/533* (2013.01); *B65H 2404/13211* (2013.01)

(58) Field of Classification Search
CPC .... B65H 31/3027; B65H 31/30; B65H 31/34; B65H 31/36; B65H 29/145; B65H 29/14; B65H 2801/27; B65H 2404/144; B65H 2404/1441; B65H 2404/1521; B65H 2404/13211; B65H 43/08; B65H 2403/533; B65H 2403/5332; G03G 15/6544
See application file for complete search history.

(56) References Cited

U.S. PATENT DOCUMENTS 7,258,339 B2 * 8/2007 Fukatsu ..... G03G 15/6538 270/58.07
10,479,636 B2 * 11/2019 Nakano ..... B65H 43/04
2012/0027484 A1 * 2/2012 Wang ..... G03G 15/6541 399/410
2013/0234384 A1 * 9/2013 Wang ..... B65H 37/04 270/58.08
2016/0176670 A1 * 6/2016 Noso ..... B65H 31/02 271/306

* cited by examiner

*Primary Examiner* — Luis A Gonzalez
(74) *Attorney, Agent, or Firm* — WPAT, PC

(57) ABSTRACT

A printing device includes a sheet placement plate, an ejection roller module and an ejection control module. The ejection roller module is located near the sheet placement plate to eject at least one paper sheet. The ejection control module is connected with the ejection roller module. The ejection roller module is selectively in a released state or an ejection state under control of the ejection control module. When the ejection roller module is in the released state, the at least one paper sheet is transferred to the sheet placement plate through the ejection roller module. The ejection roller module is in the ejection state, the at least one paper sheet is outputted by the ejection roller module.

13 Claims, 6 Drawing Sheets

PRINTING DEVICE AND EJECTION CONTROL MODULE

FIELD OF THE INVENTION

The present invention relates to a printing device, and more particularly to a printing device with a special function.

BACKGROUND OF THE INVENTION

Printing devices are common information apparatuses in modern offices for printing required documents on paper sheets. For example, the printing devices include copiers, printers, scanners and multifunction peripherals. The multifunction peripheral integrates the functions of a copier, a printer and a scanner. Among these printing devices, printers are the most popular.

FIG. 1 is a schematic side view illustrating the structure of a conventional printing device. The printing device 1 comprises a casing 10, a sheet input tray 11, a printing module 12, a first conveying channel 13, plural first conveying roller assemblies 14 and a stapling device 15. The casing 10 has a top surface 101 and an exit 102. The exit 102 is formed in the top surface 101 of the casing 10. The sheet input tray 11 is disposed within the casing 10 for placing plural paper sheets P thereon. The first conveying channel 13 is disposed within the casing 10. Moreover, the first conveying channel 13 is arranged between the sheet input tray 11 and the exit 102 for allowing the plural paper sheets P to go through. The plural first conveying roller assemblies 14 are disposed in the first conveying channel 13. By the plural first conveying roller assemblies 14, the plural paper sheets P on the sheet input tray 11 are transferred to the exit 102. The printing module 12 is disposed in the first conveying channel 13 for printing images on the plural paper sheets P. The stapling device 15 is disposed on the top surface 101 of the casing 10. The exit 102 is sheltered by the stapling device 15. The stapling device 15 comprises a stapling module 151, a sheet handling tray 152, a second conveying channel 153 and plural second conveying roller assemblies 154.

The second conveying channel 153 of the stapling device 15 is in contact with the exit 102 of the casing 10. Consequently, the second conveying channel 153 and the first conveying channel 13 are in communication with each other for allowing the plural paper sheets P to go through. The plural second conveying roller assemblies 154 are disposed in the second conveying channel 153. By the plural second conveying roller assemblies 154, the plural paper sheets P from the first conveying channel 13 are transferred to the sheet handling tray 152 and placed on the sheet handling tray 152. The stapling module 151 is located beside the sheet handling tray 152 for stapling the plural paper sheets P on the sheet handling tray 152. After the plural paper sheets P are printed by the printing module 12 of the printing device 1, the plural paper sheets P are stapled by the stapling device 15. In comparison with the manual stapling process, the use of the printing device 1 is time-saving because it is not necessary to wait for the completion of the printing operations on the plural paper sheets P and the manual stapling action is omitted.

While the printing device 1 performs the stapling operation on the plural paper sheets P, the second conveying roller assembly 154 close to the sheet handling tray 152 needs to have the moving function. When the two rollers of the second conveying roller assembly 154 are separated from each other, the paper sheets P can be transferred through the space between the two rollers so as to be stapled. After the stapling operation is completed, the two rollers of the second conveying roller assembly 154 close to the sheet handling tray 152 are moved to clamp the paper sheets P and transfer the paper sheets P. Consequently, the paper sheets P are outputted from the stapling device 15. Generally, for moving the two rollers of the second conveying roller assembly 154, a power element (e.g., a motor) capable of generating a strong motive force is needed. Consequently, a stronger clamping force can be provided. If the clamping force is not sufficient, the paper sheets P cannot be firmly clamped by the second conveying roller assembly 154. Under this circumstance, a paper transfer failure problem occurs.

Therefore, there is a need of providing an improved printing device for avoiding a paper transfer failure problem.

SUMMARY OF THE INVENTION

An object of the present invention provides a printing device for avoiding a paper transfer failure problem.

Another object of the present invention provides an ejection control module for avoiding a paper transfer failure problem.

In accordance with an aspect of the present invention, a printing device is provided. The printing device includes a sheet placement plate, an ejection roller module and an ejection control module. At least one paper sheet is placed on the sheet placement plate. The ejection roller module is located near the sheet placement plate to eject the at least one paper sheet. The ejection control module is connected with the ejection roller module. The ejection roller module is selectively in a released state or an ejection state under control of the ejection control module. When the ejection roller module is in the released state, the at least one paper sheet is transferred to the sheet placement plate through the ejection roller module. When the ejection roller module is in the ejection state, the at least one paper sheet is outputted by the ejection roller module.

In an embodiment, the ejection roller module includes a first roller assembly, a second roller assembly, a first gear set and a first power element. The first roller assembly is connected with the ejection control module. The second roller assembly is located beside the first roller assembly and connected with the ejection control module. The first gear set is connected with the first roller assembly and the second roller assembly to drive respective rotations of the first roller assembly and the second roller assembly. The first power element is connected with the first gear set to provide first motive power to the first gear set. The first motive power is transferred to the first roller assembly and the second roller assembly through the first gear set. Consequently, the first roller assembly is rotated in a first direction and the second roller assembly is rotated in a second direction.

In an embodiment, the ejection control module includes a first connection part, a second connection part, a switching element, a switching gear, a second gear set and a second power element. The first connection part is connected with a first roller assembly of the ejection roller module for driving movement of the first roller assembly. The first connection part includes a first groove. The second connection part is connected with a second roller assembly of the ejection roller module for driving movement of the second roller assembly. The second connection part includes a second groove. The switching element is connected with the first connection part and the second connection part. When the switching element is moved relative to the sheet placement plate, the first connection part and the second connection part are correspondingly moved. Consequently, the first roller assembly and the second roller assembly are correspondingly moved. The switching gear is engaged with the switching element. When the switching gear is rotated, the switching element is correspondingly moved relative to the sheet placement plate. The second gear set is engaged with the switching gear for driving a rotation of the switching gear. The second power element is connected with the second gear set to provide second motive power to the second gear set and the switching gear. When the switching gear is rotated, the switching element is moved relative to the sheet placement plate.

In accordance with another aspect of the present invention, an ejection control module for a printing device. The printing device includes a sheet placement plate and an ejection roller module. The ejection control module is connected with the ejection roller module. The ejection control module includes a first connection part, a second connection part, a switching element and a switching gear. The first connection part is connected with a first roller assembly of the ejection roller module for driving movement of the first roller assembly. The first connection part includes a first groove. The second connection part is connected with a second roller assembly of the ejection roller module for driving movement of the second roller assembly. The second connection part includes a second groove. The switching element is connected with the first connection part and the second connection part. When the switching element is moved relative to the sheet placement plate, the first connection part and the second connection part are correspondingly moved. Consequently, the first roller assembly and the second roller assembly are correspondingly moved. The switching gear engaged with the switching element. When the switching gear is rotated, the switching element is correspondingly moved relative to the sheet placement plate. The ejection roller module is selectively in a released state or an ejection state through the switching element, the switching gear, the first connection part and the second connection part.

From the above descriptions, the present invention provides the printing device and the ejection control module. Under control of the ejection control module, the operation state of the ejection roller module may be switched. Consequently, the positions of the first roller assembly and the second roller assembly are adjustable. In such way, the first roller assembly and the second roller assembly can clamp the paper sheets when the ejection roller module is in the ejection state. When the ejection roller module is in the released state, a gap is formed between the first roller assembly and the second roller assembly for allowing the paper sheets to go through. In the printing device and the ejection control module of the present invention, the positions of the first roller assembly and the second roller assembly are adjustable through the simple mechanical structure. Consequently, the paper transfer failure problem occurred in the conventional technology is solved. When the ejection roller module is in the ejection state, the first connection part and the second connection part are locked and not moved. When compared with the conventional technology, the high-force power element is not needed.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
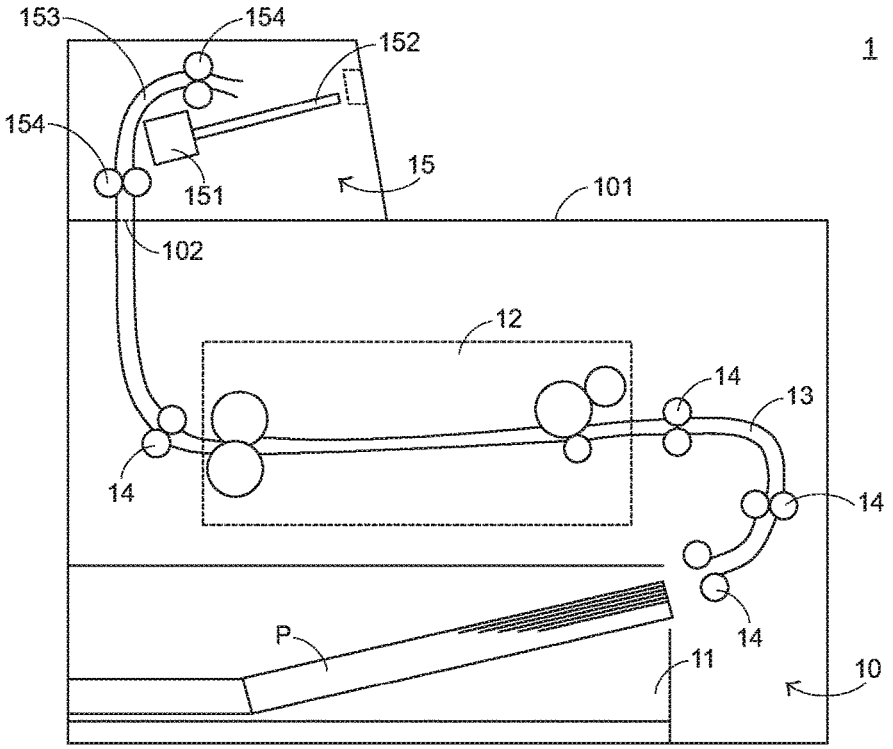
FIG.1 PRIOR ART
FIG. 1 is a schematic side view illustrating the structure of a conventional printing device.

For solving the drawbacks of the conventional technologies, the present invention provides an ejection control module and a printing device. The embodiments of present invention will be described more specifically with reference to the following drawings. For well understanding the present invention, the elements shown in the drawings are not in scale with the elements of the practical product. In the following embodiments and drawings, the elements irrelevant to the concepts of the present invention or the elements well known to those skilled in the art are omitted. It is noted that numerous modifications and alterations may be made while retaining the teachings of the invention.

Figure 2:
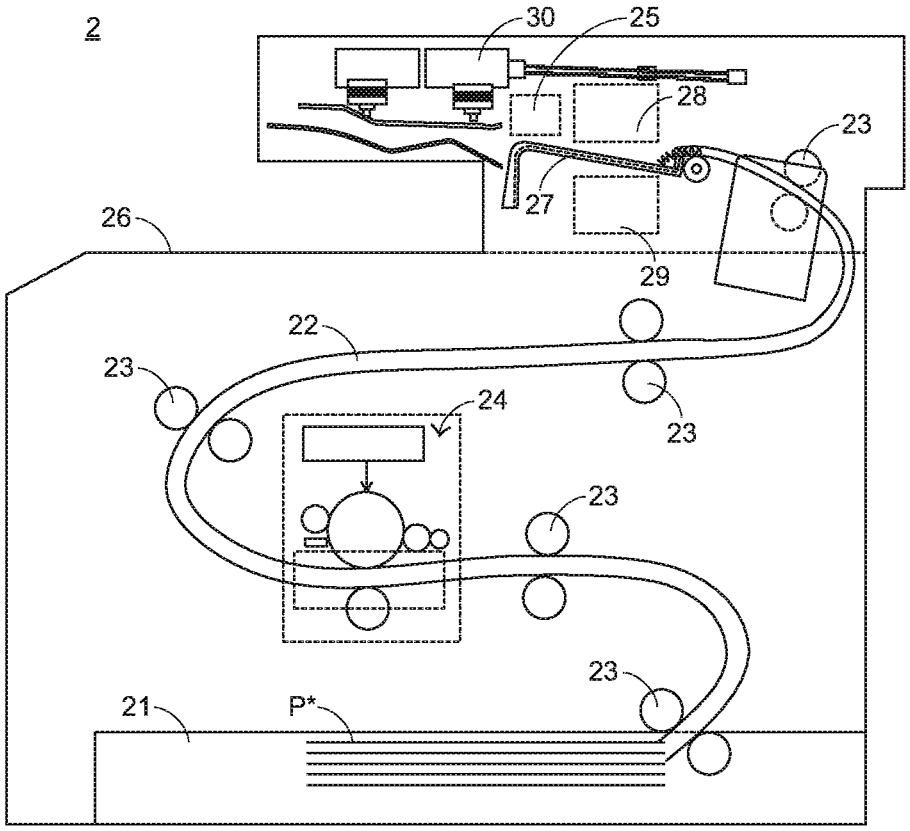
FIG. 2 is a schematic side view illustrating the structure of a printing device according to an embodiment of the present invention.

The structure of the printing device of the present invention will be described as follows. FIG. 2 is a schematic side view illustrating the structure of a printing device according to an embodiment of the present invention. As shown in FIG. 2, the printing device 2 comprises a sheet input tray 21, a conveying channel 22, plural conveying roller assemblies 23, a printing module 24, a management module 25, a sheet output tray 26, a sheet placement plate 27, an ejection roller module 28, an ejection control module 29 and a stapling module 30.

The sheet input tray 21 is located at a bottom of the printing device 2 for placing the plural paper sheets P* thereon. The conveying channel 22 is arranged between the sheet input tray 21 and the sheet placement plate 27 for allowing the plural paper sheets P* to go through. The plural conveying roller assemblies 23 are disposed in the conveying channel 22 for moving the plural paper sheets P* along the conveying channel 22. The printing module 24 is located near the conveying channel 22. When the paper sheets P* are transported across the printing module 24, the paper sheets P* are printed by the printing module 24. The management module 25 is located near the sheet placement plate 27. When the paper sheets P* are moved to the nearby position of the management module 25, the paper sheets P* are managed by the management module 25. Consequently, the paper sheets P* are aligned with each other. The printing operation of the printing module 24 and the managing operation of the management module 25 are well known to those skilled in the art, and not redundantly described herein.

The sheet placement plate 27 is located near the sheet output tray 26. The paper sheets P* can be placed on the sheet placement plate 27. The ejection roller module 28 is located near the sheet placement plate 27 for transferring the paper sheets P* to the sheet output tray 26. The ejection control module 29 is connected with the ejection roller module 28. Under control of the ejection control module 29, the ejection roller module 28 is selectively in a released state or an ejection state. When the ejection roller module 28 is in the released state, the paper sheets P* can be transported through the ejection roller module 28 and released to the sheet placement plate 27. When the ejection roller module 28 is in the ejection state, the paper sheets P* can be transferred to the sheet output tray 26. The stapling module 30 is located over the sheet output tray 26. After the paper sheets P* are aligned with each other, the aligned paper sheets P* can be stapled by the stapling module 30.

Figure 3:
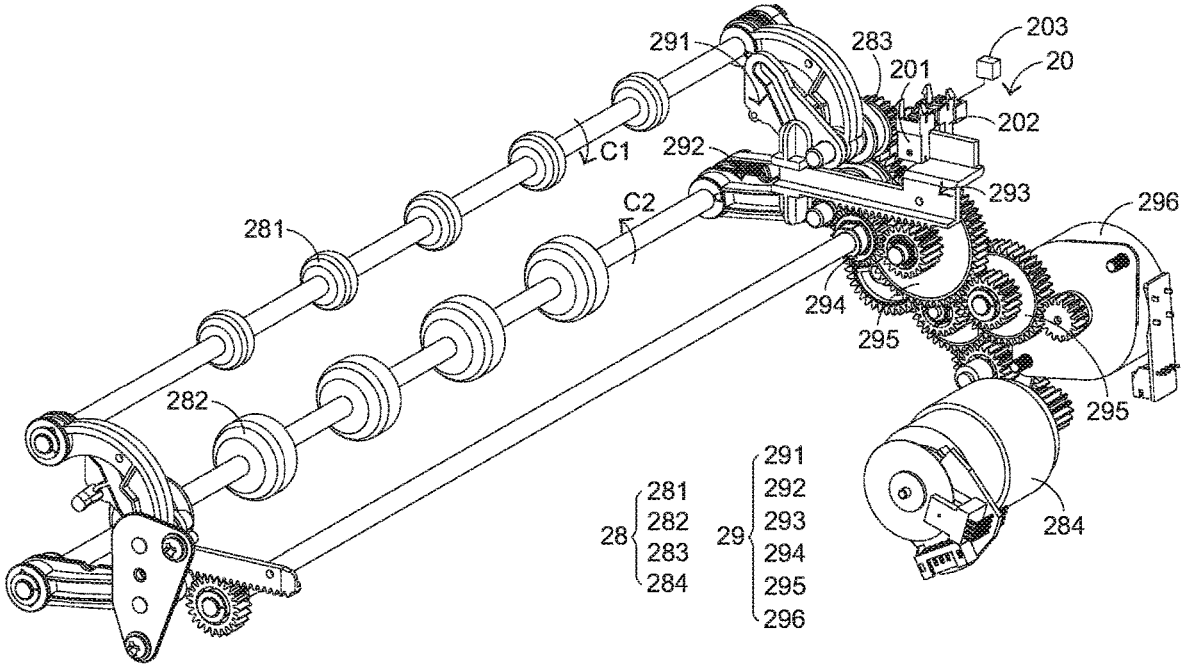
FIG. 3 is a schematic perspective view illustrating the ejection roller module and the ejection control module of the printing device according to the embodiment of the present invention, in which the ejection roller module is in a released state.
Figure 4:
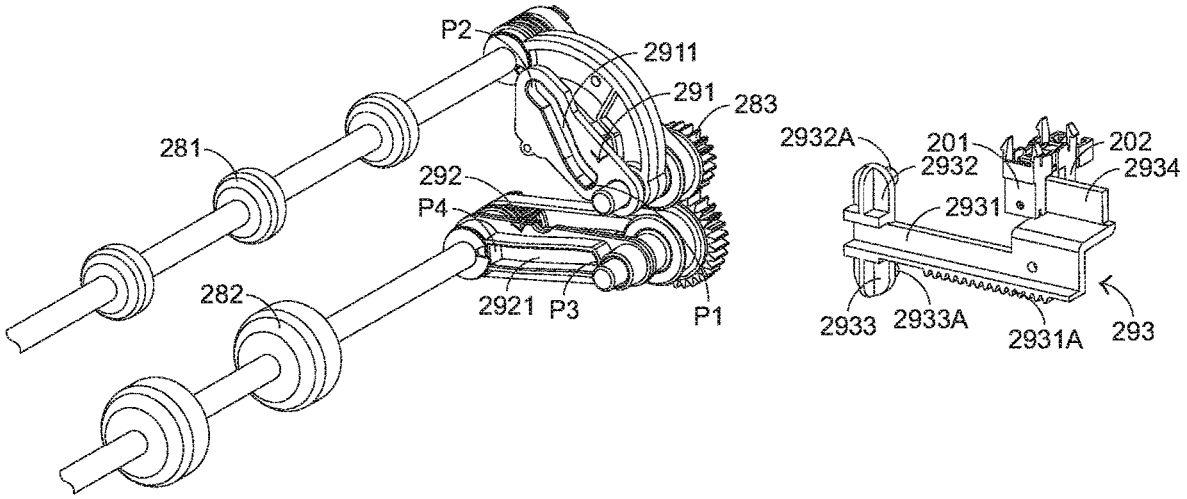
FIG. 4 is a schematic exploded view illustrating a portion of the ejection control module of the printing device according to the embodiment of the present invention.

The structures of the printing device 2 will be described in more details as follows. FIG. 3 is a schematic perspective view illustrating the ejection roller module and the ejection control module of the printing device according to the embodiment of the present invention, in which the ejection roller module is in a released state. FIG. 4 is a schematic exploded view illustrating a portion of the ejection control module of the printing device according to the embodiment of the present invention. Please refer to FIGS. 2, 3 and 4. The ejection roller module 28 comprises a first roller assembly 281, a second roller assembly 282, a first gear set 283 and a first power element 284. The first roller assembly 281 is connected with the ejection control module 29. The second roller assembly 282 is located beside the first roller assembly 281 and connected with the ejection control module 29. The first gear set 283 is connected with the first roller assembly 281 and the second roller assembly 282 in order to drive respective rotations of the first roller assembly 281 and the second roller assembly 282. The first power element 284 is connected with the first gear set 283. When the first power element 284 is enabled, the first power element 284 provides first motive power to the first gear set 283. The first motive power is transferred to the first roller assembly 281 and the second roller assembly 282 through the first gear set 283. Consequently, the first roller assembly 281 is rotated in a first direction C1, and the second roller assembly 282 is rotated in a second direction C2. The first direction C1 and the second direction C2 are opposite to each other.

The ejection control module 29 comprises a first connection part 291, a second connection part 292, a switching element 293, a switching gear 294, a second gear set 295 and a second power element 296. The first connection part 291 is connected with the first roller assembly 281 for driving movement of the first roller assembly 281. The first connection part 291 comprises a first groove 2911. The second connection part 292 is located beside the first connection part 291. Moreover, the second connection part 292 is connected with the second roller assembly 282 for driving movement of the second roller assembly 282. The second connection part 292 comprises a second groove 2921. The switching element 293 is inserted into the first groove 2911 and the second groove 2921. Consequently, the switching element 293 is connected with the first connection part 291 and the second connection part 292. As the switching element 293 is moved relative to the sheet placement plate 27, the first connection part 291 and the second connection part 292 are correspondingly moved. The detailed structure of the switching element 293 will be described herein. As the first connection part 291 and the second connection part 292 are moved, the first roller assembly 281 and the second roller assembly 282 are correspondingly moved. Consequently, the state of the ejection roller module 28 can be switched.

Figure 5:
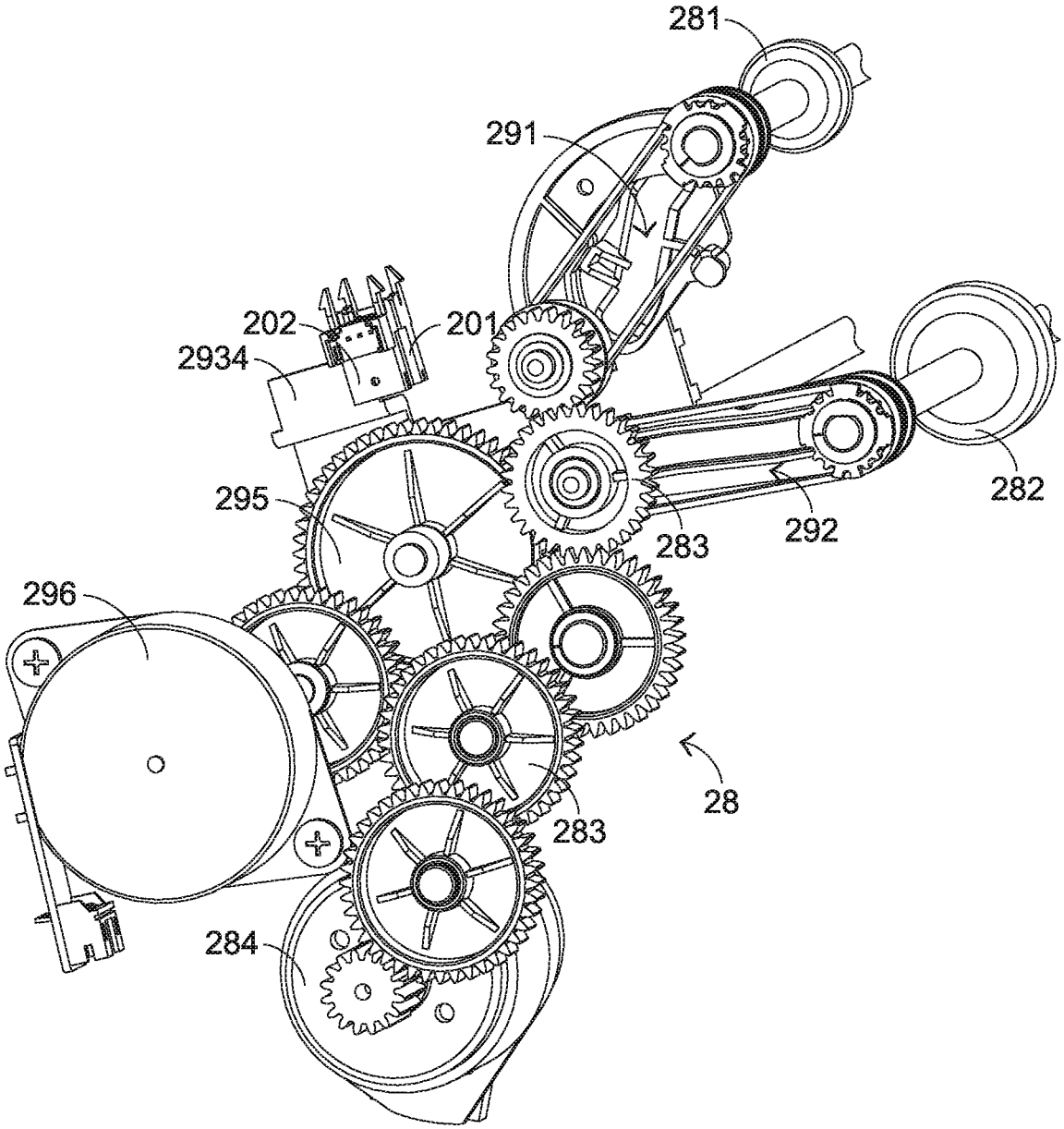
FIG. 5 is a schematic perspective view illustrating the ejection control module of the printing device according to the embodiment of the present invention and taken along another viewpoint.

FIG. 5 is a schematic perspective view illustrating the ejection control module of the printing device according to the embodiment of the present invention and taken along another viewpoint. Please refer to FIGS. 3, 4 and 5. The switching gear 294 is engaged with the switching element 293. As the switching gear 294 is rotated, the switching element 293 is moved relative to the sheet placement plate 27. The second gear set 295 is engaged with the switching gear 294 for driving the rotation of the switching gear 294. The second power element 296 is connected with the second gear set 295. When the second power element 296 is enabled, the second power element 296 provides second motive power to the second gear set 295 and the switching gear 294. Consequently, as the switching gear 294 is rotated, the switching element 293 is moved relative to the sheet placement plate 27. Preferably but not exclusively, the first power element 284 and the second power element 296 are motors.

The switching element 293 comprises a main body 2931, a first extension structure 2932 and a second extension structure 2933. The main body 2931 comprises a rack structure 2931A. The rack structure 2931A is engaged with the switching gear 294. Consequently, the switching element 293 can be moved relative to the sheet placement plate 27. The first extension structure 2932 is located at a first end of the main body 2931 and located at a first side of the main body 2931. The first extension structure 2932 comprises a first protrusion post 2932A. The first protrusion post 2932A is inserted into the first groove 2911 and movable within the first groove 2911. The second extension structure 2933 is located at the first end of the main body 2931 and located at a second side of the main body 2931. The second extension structure 2933 comprises a second protrusion post 2933A. The second protrusion post 2933A is inserted into the second groove 2921 and movable within the second groove 2921. When the switching element 293 is moved relative to the sheet placement plate 27, the first protrusion post 2932A is contacted with an inner wall of the first groove 2911 to move the first connection part 291. Moreover, the second protrusion post 2933A is contacted with an inner wall of the second groove 2921 to move the second connection part 292.

Figure 6:
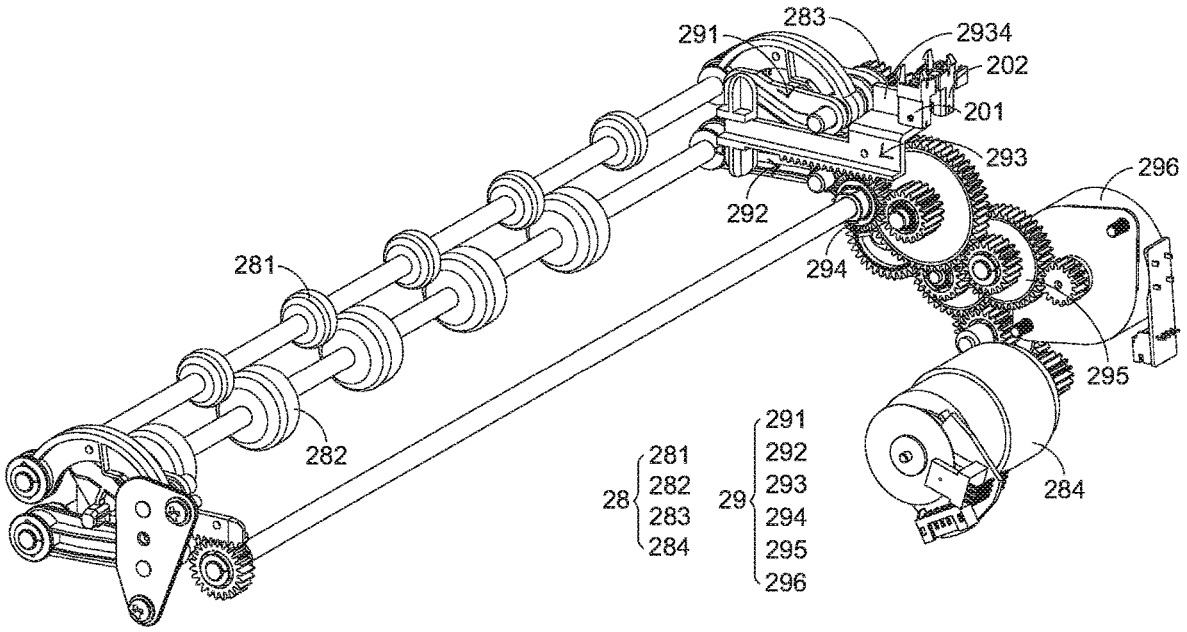
FIG. 6 is a schematic perspective view illustrating the ejection roller module and the ejection control module of the printing device according to the embodiment of the present invention, in which the ejection roller module is in an ejection state.

As the switching element 293 is moved, the ejection roller module 28 is selectively in the released state or the ejection state. When the first protrusion post 2932A is moved to a first position P1 of the first groove 2911 and the second protrusion post 2933A is moved to a third position P3 of the second groove 2921, the ejection roller module 28 is in the released state. Under this circumstance, the first roller assembly 281 and the second roller assembly 282 are moved away from each other (see FIG. 3). When the first protrusion post 2932A is moved to a second position P2 of the first groove 2911 and the second protrusion post 2933A is moved to a fourth position P4 of the second groove 2921, the ejection roller module 28 is in the ejection state. Under this circumstance, the first roller assembly 281 and the second roller assembly 282 are moved toward each other (see FIG. 6).

For assuring the normal operation of the ejection control module 29, the printing device 2 further comprises a position sensing module 20. The position sensing module 20 is located near the switching element 293 for detecting the position of the switching element 293 and calculating the moving speed of the switching element 293. According to the position and the moving speed of the switching element 293, the position sensing module 20 can judge whether the ejection control module 29 is normal. In this embodiment, the switching element 293 further comprises a third extension structure 2934. Due to the third extension structure 2934, the position sensing module 20 can judge the position of the switching element 293. The third extension structure 2934 is located at a second end of the main body 291 and located near the position sensing module 20.

In this embodiment, the position sensing module 20 comprises a light-emitting element 201, a sensor 202 and a control unit 203. The light-emitting element 201 is located near the third extension structure 2934 and located beside a first side of the third extension structure 2934. The light-emitting element 201 emits a light beam. The sensor 202 is located near the third extension structure 2934 and located beside a second side of the third extension structure 2934. According to the result of judging whether the sensor 202 receives the light beam, the sensor 202 issues a corresponding signal. When the ejection roller module 28 is in the released state or the ejection state, the third extension structure 2934 is moved to a position away from the position sensing module 20. Consequently, the sensor 202 can receive the light beam. During the transient period of switching between the released state and the ejection state, the light beam is sheltered by the third extension structure 2934. Meanwhile, the sensor 202 cannot receive the light beam.

The control unit 203 is connected with the sensor 202 to receive a first control signal and a second control signal. According to the first control signal or the second control signal, the control unit 203 obtains the time duration when no light beam is received by the sensor 202. Consequently, the control unit 203 calculates the moving speed of the switching element 293. According to the moving speed of the switching element 293, the control unit 203 judges whether the ejection control module 29 is normal. In an embodiment, the light-emitting element 201 is a light emitting diode, the sensor 202 is a light receiver, and the control unit 203 is a microprocessor.

The operations of the printing device 2 will be described as follows. When the printing device 2 is enabled, the ejection control module 29 is enabled. Meanwhile, the second power element 296 drives the rotation of the second gear set 295. As the second gear set 295 is rotated, the switching gear 294 is correspondingly rotated. As the switching gear 294 is rotated, the switching element 293 is moved relative to the sheet placement plate 27 through the rack structure 2931A. During the process of moving the switching element 293, the first protrusion post 2932A is moved to the first position P1 along the inner wall of the first groove 2911 so as to drive the movement of the first connection part 291, and the second protrusion post 2933A is moved to the third position P3 along the inner wall of the second groove 2921 so as to drive movement of the second connection part 292. Consequently, the first roller assembly 281 is moved in the direction away from the second roller assembly 282. Consequently, the ejection roller module 28 is in the released state. The above operations can assure the released state of the ejection roller module 28.

On the other hand, the plural paper sheets P* on the sheet input tray 21 are successively fed into the conveying channel 22 by the plural conveying roller assemblies 23. In addition, the paper sheets P* are transferred to the nearby position of the printing module 24. When the paper sheets P* are transported across the printing module 24, the printing module 24 performs a printing operation on the paper sheets P*. As the paper sheets P* are continuously moved within the conveying channel 22, the paper sheets P* are transferred to the sheet placement plate 27 by the plural conveying roller assemblies 23. Meanwhile, the ejection roller module 28 is in the released state, and the paper sheets P* are transferred by the plural conveying roller assemblies 23. Consequently, the first ends of the paper sheets P* are transferred to a nearby position of the management module 25 through the space between the first roller assembly 281 and the second roller assembly 282, and the second ends of the paper sheets P* are placed on the sheet placement plate 27.

Then, the paper sheets P* are managed by the management module 25. Consequently, the paper sheets P* are aligned with each other. Then, the aligned paper sheets P* are stapled by the stapling module 30. After the stapling operation on the paper sheets P* is completed, the ejection roller module 28 is switched to the ejection state. The process of switching the ejection roller module 28 to the ejection state will be described as follows. Firstly, the second power element 296 drives the rotation of the second gear set 295. As the second gear set 295 is rotated, the switching gear 294 is correspondingly rotated. As the switching gear 294 is rotated, the switching element 293 is moved relative to the sheet placement plate 27 through the rack structure 2931A. During the process of moving the switching element 293, the first protrusion post 2932A is moved to the second position P2 along the inner wall of the first groove 2911 so as to drive the movement of the first connection part 291, and the second protrusion post 2933A is moved to the fourth position P4 along the inner wall of the second groove 2921 so as to drive movement of the second connection part 292. When the first protrusion post 2932A is moved to the second position P2 and the second protrusion post 2933A is moved to the fourth position P4, the first connection part 291 and the second connection part 292 are respectively stopped by the first protrusion post 2932A and the second protrusion post 2933A. Consequently, the first connection part 291 and the second connection part 292 are not moved relative to the sheet placement plate 27. Since the first connection part 291 and the second connection part 292 are locked by the mechanism components, the first connection part 291 and the second connection part 292 are not moved. Consequently, the ejection control module 29 does not need to use a high-force power element to lock the first connection part 291 and the second connection part 292.

In this way, the first roller assembly 281 is moved toward the second roller assembly 282. Consequently, the ejection roller module 28 is in the ejection state. The paper sheets P* are arranged between the first roller assembly 281 and the second roller assembly 282. That is, the paper sheets P* are clamped by the first roller assembly 281 and the second roller assembly 282. Moreover, due to the operation of the ejection roller module, the paper sheets P* are outputted from the sheet placement plate 27 to the sheet output tray 26 by the first roller assembly 281 and the second roller assembly 282. The operations of the printing device 2 have been described as above.

It is noted that numerous modifications and alterations may be made while retaining the teachings of the invention. For example, in another embodiment, the printing device is not equipped with the stapling module.

From the above descriptions, the present invention provides the printing device and the ejection control module. Under control of the ejection control module, the operation state of the ejection roller module may be switched. Consequently, the positions of the first roller assembly and the second roller assembly are adjustable. In such way, the first roller assembly and the second roller assembly can clamp the paper sheets when the ejection roller module is in the ejection state. When the ejection roller module is in the released state, a gap is formed between the first roller assembly and the second roller assembly for allowing the paper sheets to go through. In the printing device and the ejection control module of the present invention, the positions of the first roller assembly and the second roller assembly are adjustable through the simple mechanical structure. Consequently, the paper transfer failure problem occurred in the conventional technology is solved. When the ejection roller module is in the ejection state, the first connection part and the second connection part are locked and not moved. When compared with the conventional technology, the high-force power element is not needed.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A printing device, comprising:

a sheet placement plate, wherein at least one paper sheet is placed on the sheet placement plate;

an ejection roller module located adjacent to the sheet placement plate to eject the at least one paper sheet; and an ejection control module connected with the ejection roller module, comprising:

a first connection part connected with a first roller assembly of the ejection roller module for driving movement of the first roller assembly, wherein the first connection part comprises a first groove;

a second connection part connected with a second roller assembly of the ejection roller module for driving movement of the second roller assembly, wherein the second connection part comprises a second groove;

a switching element connected with the first connection part and the second connection part, wherein when the switching element is moved relative to the sheet placement plate, the first connection part and the second connection part are correspondingly moved, so that the first roller assembly and the second roller assembly are correspondingly moved;

a switching gear engaged with the switching element, wherein when the switching gear is rotated, the switching element is correspondingly moved relative to the sheet placement plate;

a second gear set engaged with the switching gear for driving a rotation of the switching gear; and a second power element connected with the second gear set, for providing second motive power to the second gear set and the switching gear, wherein when the switching gear is rotated, the switching element is moved relative to the sheet placement plate;

wherein the ejection roller module is selectively in a released state or an ejection state under control of the ejection control module, wherein when the ejection roller module is in the released state, the at least one paper sheet is transferred to the sheet placement plate through the ejection roller module, wherein when the ejection roller module is in the ejection state, the at least one paper sheet is outputted by the ejection roller module.

2. The printing device according to claim 1, wherein the ejection roller module comprises:

a first roller assembly connected with the ejection control module;

a second roller assembly located beside the first roller assembly and connected with the ejection control module;

a first gear set connected with the first roller assembly and the second roller assembly to drive respective rotations of the first roller assembly and the second roller assembly; and a first power element connected with the first gear set, and providing first motive power to the first gear set, wherein the first motive power is transferred to the first roller assembly and the second roller assembly through the first gear set, so that the first roller assembly is rotated in a first direction and the second roller assembly is rotated in a second direction.

3. The printing device according to claim 1, wherein the switching element comprises:

a main body comprising a rack structure, wherein the rack structure is engaged with the switching gear, so that the switching element is movable relative to the sheet placement plate;

a first extension structure located at a first end of the main body and located at a first side of the main body, wherein the first extension structure comprises a first protrusion post, and the first protrusion post is inserted into the first groove and movable within the first groove; and a second extension structure is located at the first end of the main body and located at a second side of the main body, wherein the second extension structure comprises a second protrusion post, and the second protrusion post is inserted into the second groove and movable within the second groove, wherein when the switching element is moved relative to the sheet placement plate, the first protrusion post is contacted with the first groove to move the first connection part, and the second protrusion post is contacted with the second groove to move the second connection part.

4. The printing device according to claim 3, wherein when the first protrusion post is moved to a first position of the first groove and the second protrusion post is moved to a third position of the second groove, the ejection roller module is in the released state, and the first roller assembly and the second roller assembly are moved away from each other, wherein when the first protrusion post is moved to a second position of the first groove and the second protrusion post is moved to a fourth position of the second groove, the first connection part and the second connection part are respectively stopped by the first protrusion post and the second protrusion post and not moved relative to the sheet placement plate, so that the ejection roller module is in the ejection state and the first roller assembly and the second roller assembly are moved toward each other.

5. The printing device according to claim 3, further comprising a position sensing module, wherein the position sensing module is located adjacent to the switching element, and the position sensing module detects a position of the switching element and calculates a moving speed of the switching element, wherein according to the position and the moving speed of the switching element, the position sensing module judges whether the ejection control module is normal.

6. The printing device according to claim 5, wherein the switching element further comprises a third extension structure, and the third extension structure is located at a second end of the main body, wherein the position sensing module comprises:

a light-emitting element located beside a first side of the third extension structure, wherein the light-emitting element emits a light beam;

a sensor located beside a second side of the third extension structure, wherein according to a result of judging whether the sensor receives the light beam, the sensor issues a first control signal or a second control signal, wherein when the ejection roller module is in the released state or the ejection state, the light beam is received by the sensor, wherein during a transient period of switching the ejection roller module between the released state and the ejection state, the light beam is sheltered by the third extension structure and the light beam is not received by the sensor; and a control unit connected with the sensor, and calculating the moving speed of the switching element according to the first control signal or the second control signal, thereby judging whether the ejection control module is normal.

7. The printing device according to claim 1, further comprising:

a sheet input tray, wherein the at least one paper sheet is placed on the sheet input tray;

a conveying channel arranged between the sheet input tray and the sheet placement plate, wherein the at least one paper sheet is permitted to be transferred through the conveying channel;

plural conveying roller assemblies disposed in the conveying channel, wherein the at least one paper sheet is moved along the conveying channel by the plural conveying roller assemblies;

a printing module located adjacent to the conveying channel, wherein when the at least one paper sheet is transported across the printing module, the printing module performs a printing operation on the at least one paper sheet; and a management module located adjacent to the sheet placement plate, wherein the at least one paper sheet comprises plural paper sheets, wherein the plural paper sheets are managed by the management module, so that the plural paper sheets are aligned with each other.

8. The printing device according to claim 7, wherein when the ejection roller module is in the released state and the plural paper sheets are transferred by the plural conveying roller assemblies, first ends of the plural paper sheets are transferred to the management module through a space between the first roller assembly and the second roller assembly, and second ends of the plural paper sheets are placed on the sheet placement plate, wherein when the ejection roller module is in the ejection state, the aligned paper sheets are clamped by the first roller assembly and the second roller assembly and ejected from the sheet placement plate.

9. The printing device according to claim 8, wherein the printing device further comprises a stapling module, and the stapling module is located over a sheet output tray for stapling the aligned paper sheets, wherein after the aligned paper sheets are ejected from the sheet placement plate and moved towards the stapling module, the aligned paper sheets are stapled by the stapling module.

10. An ejection control module for a printing device, the printing device comprising a sheet placement plate and an ejection roller module, the ejection control module being connected with the ejection roller module, the ejection control module comprising:

a first connection part connected with a first roller assembly of the ejection roller module for driving movement of the first roller assembly, wherein the first connection part comprises a first groove;

a second connection part connected with a second roller assembly of the ejection roller module for driving movement of the second roller assembly, wherein the second connection part comprises a second groove;

a switching element connected with the first connection part and the second connection part, wherein when the switching element is moved relative to the sheet placement plate, the first connection part and the second connection part are correspondingly moved, so that the first roller assembly and the second roller assembly are correspondingly moved; and a switching gear engaged with the switching element, wherein when the switching gear is rotated, the switching element is correspondingly moved relative to the sheet placement plate, wherein the ejection roller module is selectively in a released state or an ejection state through the switching element, the switching gear, the first connection part and the second connection part.

11. The ejection control module according to claim 10, further comprising:

a gear set engaged with the switching gear for driving a rotation of the switching gear; and a power element connected with the second gear set, and providing motive power to the gear set and the switching gear, wherein when the switching gear is rotated, the switching element is moved relative to the sheet placement plate.

12. The ejection control module according to claim 10, wherein the switching element comprises:

a main body comprising a rack structure, wherein the rack structure is engaged with the switching gear, so that the switching element is movable relative to the sheet placement plate;

a first extension structure located at a first end of the main body and located at a first side of the main body, wherein the first extension structure comprises a first protrusion post, and the first protrusion post is inserted into the first groove and movable within the first groove; and a second extension structure is located at the first end of the main body and located at a second side of the main body, wherein the second extension structure comprises a second protrusion post, and the second protrusion post is inserted into the second groove and movable within the second groove, wherein when the switching element is moved relative to the sheet placement plate, the first protrusion post is contacted with the first groove to move the first connection part, and the second protrusion post is contacted with the second groove to move the second connection part.

13. The ejection control module according to claim 12, wherein when the first protrusion post is moved to a first position of the first groove and the second protrusion post is moved to a third position of the second groove, the ejection roller module is in the released state, and the first roller assembly and the second roller assembly are moved away from each other, wherein when the first protrusion post is moved to a second position of the first groove and the second protrusion post is moved to a fourth position of the second groove, the first connection part and the second connection part are respectively stopped by the first protrusion post and the second protrusion post and not moved relative to the sheet placement plate, so that the ejection roller module is in the ejection state and the first roller assembly and the second roller assembly are moved toward each other.

* * * * *